United States Patent [19]

Bach et al.

[11] 3,957,264

[45] May 18, 1976

[54] COLLATOR BINS

[75] Inventors: Paul S. Bach, Boulder, Colo.; James A. Craft, Lexington, Ky.; Gerald B. Lammers, Boulder County; James C. Rogers, Boulder, both of Colo.

[73] Assignee: International Business Machines Corporation, Armonk, N.Y.

[22] Filed: Aug. 7, 1975

[21] Appl. No.: 602,957

[52] U.S. Cl. ..... 271/173; 271/188; 271/208; 271/209; 271/182

[51] Int. Cl.[2] ..... B65H 39/10

[58] Field of Search ..... 271/64, 173, 182, 188, 271/208, 209, 207; 270/58

[56] References Cited

UNITED STATES PATENTS

| | | | |
|---|---|---|---|
| 2,492,386 | 12/1949 | Little | 271/173 |
| 3,802,694 | 4/1974 | Post | 271/173 |
| 3,807,726 | 4/1974 | Hope | 271/209 X |

*Primary Examiner*—Richard A. Schacher
*Attorney, Agent, or Firm*—Francis A. Sirr

[57] ABSTRACT

A copier/collator installation wherein the copier's output copy sheets are collated into sets in a multi-bin collator. The collator bins are vertically stacked.

Vertical stacking of the electrostatically charged and heated copy sheets, which therefore tend to curl, is enhanced by providing collator bins having electrically nonconductive walls. The bottom sheet-receiving walls are formed to have a generally concave cross section, facing upward. Considering the direction of sheet movement, this concave surface extends generally transverse the sheet movement. Pivoted and biased paper stabilizing wires hold down the leading portion of the sheet stack in the bin, and also absorbs the sheet's kinetic energy as the sheet enters the bin. A flexible, electrically nonconductive plastic flap, at the bin's entrance or mouth, holds down the sheet's trailing portion, and also absorbs the sheet's kinetic energy. A sheet discharging electrically conductive tinsel is mounted in the top of the bin, intermediate the stabilizing wire and the flap. This tinsel is mounted generally behind the flap so as not to physically engage the sheet.

9 Claims, 6 Drawing Figures

COLLATOR BINS

BACKGROUND AND SUMMARY OF THE INVENTION

This invention relates to the field of collators and to the construction of a collator bin, this construction being such as to facilitate the stacking of a large number of sheets into a compact space.

As is well known to those in the art, cut paper is received from the manufacturer in stacks, all sheets having the more dense and smooth felt side facing one direction and the wire side facing the other direction. Generally, the sheets are cut grain-long. That is, the longest sheet dimension is aligned with the paper's grain fibers. As a result, the paper tends to curl in its shortest dimension, or cross-grain. Paper manufacturers generally recommend that printing be placed on the felt side.

Most methods of printing, and particularly the xerographic method of printing wherein loose toner is melted or fused onto the paper, result in the heating and drying of the printed sheet. As is also well known, this heated paper tends to curl toward the wire side of the sheet. This curl causes the sheet to assume a cylindrical concave shape, curled along its longest dimension, due to it being cut grain-long.

By way of example, sheet curl, measured from the plane of its upturned edges to a parallel plane cutting the apex of its curl, is from 0.2 to 0.6 inch. Greater curl is experienced with paper of higher moisture content.

Prior art collating apparatus generally provide a plurality of horizontal or vertically stacked bins, whose sheet holding capacity is restricted by the size of each individual bin, and by the ability to insert a sheet into the bin without jamming the leading edge of that sheet against the trailing edge of the sheets already stacked in the bin. Various means such as flaps and wire guides are provided in the prior art to hold down the trailing edge of the sheets already in the bin, so as to allow the leading edge of the subsequent sheet to enter the bin without a jam.

The present invention is directed to the vertical stacking of sheets which have a tendency to curl in a collator bin having a small finite capacity. Stacking in the bin is enhanced by providing a bin whose generally horizontally disposed lower wall is comprised of oppositely inclined nonhorizontal portions. The entrance portion and the back portion of the bin are both generally inclined upward, to form a quasi curved or concave surface which faces upward. This concave surface which, if it were circular, is formed about an axis generally normal to the direction of sheet travel. A limitation of the present invention is that the generally concave shape of the bottom of each collator bin is somewhat greater than the curvature to be expected by the curling of the sheets due to the printing process. As a result, if the paper resides in the bin with the leading and trailing edges of the sheets curled down, these edges engage the bottom surface of the bin in line contact and tend to "break the back" of the sheet. Thus, the leading edge of the next sheet to be inserted in the bin does not encounter the upturned edge of the sheets already within the bin, this being the condition most likely to cause a sheet jam. The other condition of possible sheet stacking is wherein the sheets enter the bin curled upward. In this case, since the curvature of the collator bin is greater than that of the paper, the leading and trailing sheet edges again engage the bottom of the bin in line contact. The back of the bent sheet is again broken and the sheets reside in the tray with their trailing and leading edges tightly packed, so as to avoid interference with the leading edge of the sheet subsequently to be stacked in the bin.

As can be appreciated, this invention is of particular utility when grain-long cut sheets are fed in the direction of their shortest dimension, such that the tendency to curl results in a generally curved quasi cylindrical surface formed about an axis normal to the direction of sheet travel.

As a result of this unique construction, apparatus functioning in accordance with the teachings of the present invention have succeeded in stacking as many as 100 sheets into a bin having vertical height of approximately 1.3 inches.

The foregoing and other features and advantages of the invention will be apparent from the following more particular description of preferred embodiments of the invention, as illustrated in the accompanying drawing.

DESCRIPTION OF THE PREFERRED EMBODIMENTS

Figure 1:
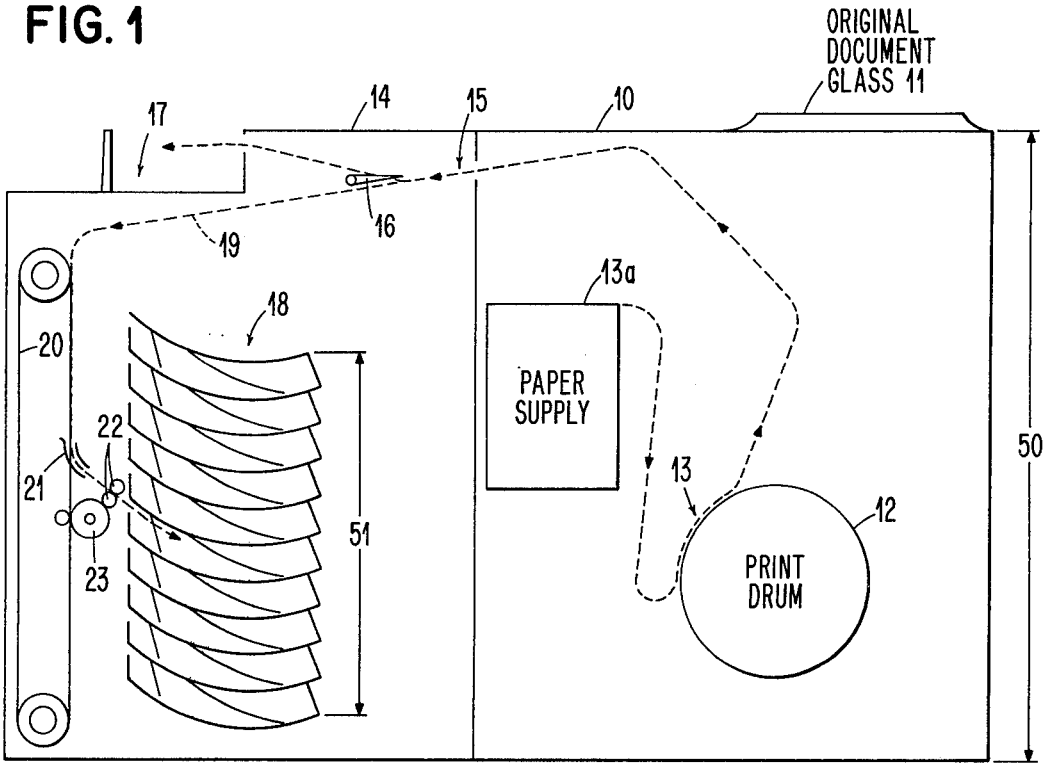
FIG. 1 discloses a printer/collator assembly, the collator embodying the collator bins of the present invention.

FIG. 1 discloses a printer/collator installation wherein copier/printer 10 includes an original document glass 11 upon which an original to be copied is placed. Copier 10 is shown to be a xerographic copier. By means well known to those skilled in the art a latent electrostatic image is formed on drum 12. This image is toned, and the toner is transferred to a sheet of plain paper at transfer station 13. Paper is supplied to transfer station 13 from a paper supply bin 13*a* holding a large number of cut sheets in a vertical stack. As mentioned, the present invention has particular utility when these grain-long cut sheets are stacked such that they are fed in the direction of their shortest dimension. Thus, for example, 8 ½ × 11 inch sheets are fed in the direction of their 8 ½ inch dimension. After toner is deposited on a sheet, it is fused thereto by a heater (not shown) and exits the copier, entering collator 14 at sheet path point 15. A sheet deflecting vane 16 is operable in one position to cause the sheets to exit to copy tray 17. In the other position of the vane the sheets enter the stack of vertically oriented collator bins 18. The sheets follow sheet path 19 and are deposited on vertically extending sheet transport belts 20. These belts move continuously and operate to transport the sheets to a movable deflector 21. The position of this deflector determines the individual collator bin into which a sheet will be inserted. The sheets are driven into the bin by drive rollers 22, these drive rollers being driven from the continuously moving belts by means of rollers 23.

For operator convenience, the vertical height 50 of this installation is approximately 40 inches. Thus, it is desirable to place as many as twenty individual bins within the vertical height 51 of appproximately 26 inches. As the number of bins increases, the height of each bin of course decreases. An exemplary collator constructed in accordance with the present invention places twenty bins in a vertical height of 26 inches, thus providing individual bins 1.3 inches in height. This relatively shallow bin construction would seriously restrict the ability of the installation to collate sets having a large number of sheets. However, with the bin construction of the present invention, as many as 100 sheets can be reliably stacked in a bin.

Figure 2:
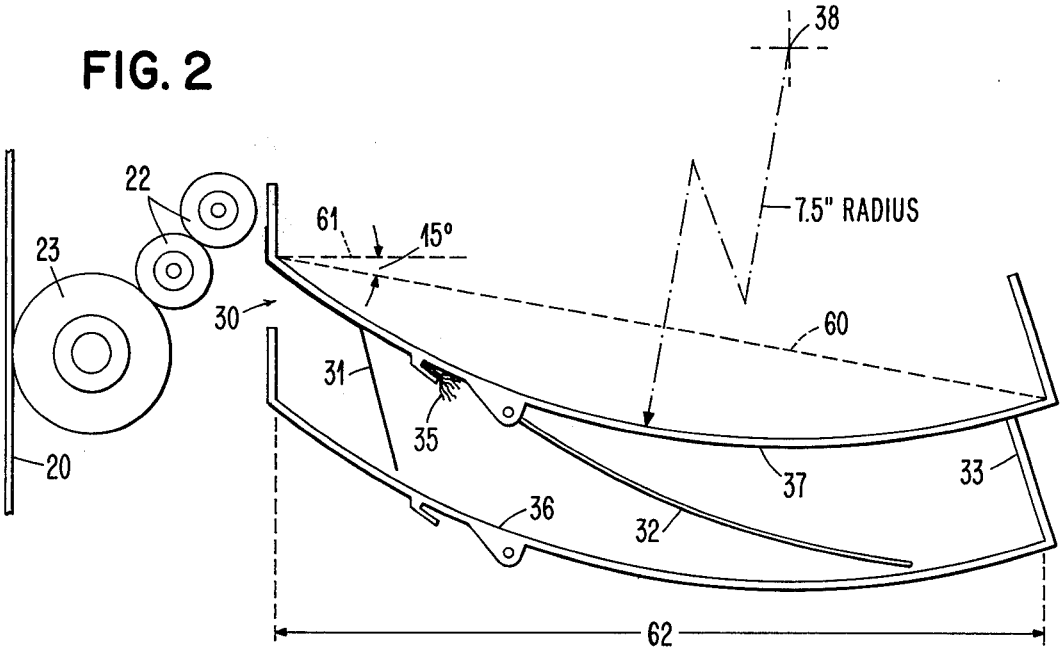
FIG. 2 is an enlarged showing of one of the collator bins of FIG. 1.

FIG. 2 is an enlarged showing of one of the collator bins of FIG. 1. Specifically, each individual bin includes an open mouth 30 into which the leading edge of the sheet is driven. This mouth, and the entire bin is approximately 15 inches long, measured in a direction normal to sheet travel, so as to accommodate legal size paper which is moving in the direction of its shortest dimension. The sheet's leading edge first encounters an electrically nonconductive plastic entrance flap 31, for example made of the material known as Mylar. This flap engages the sheet with line contact, thus ensuring uniform deceleration force across the sheet, with minimum resultant sheet skew. The Mylar flap is, for example, 0.004 inch thick. Thereafter, the sheet's leading edge engages a gravity-biased metallic hold-down wire form 32. Form 32 may be constructed of wire having a diameter of 0.06 inches. Both of the members 31 and 32 comprise flap members which decelerate the sheet by absorbing its kinetic energy. Both of these members extend across the width of the bin, normal to sheet travel. Hold-down wire 32 may, for example, be two pivoted forms, each one of which is generally in the shape of a V when viewed from above. This construction provides a desirable small, two-point surface area contact to the sheet. These two independent wire forms can therefore seek their own height, on top of the stack, independent of the other form, and therefore contact the sheet stack with the same pressure for each form. Ideally, the sheet arrives at the bin's back wall 33 were the sheet stops without rebound toward the mouth of the bin. More preferably, the bin's back wall comprises two spaced, vertically extending stationary impact bars which limit area contact to the edge of the sheets. This construction reduces the sound level associated with the insertion of a sheet into the bin.

The sheet movement and rubbing normally associated with a printer and a collator generally causes the sheet to electrostatically charge. This is particularly true when the printer is a xerographic copier wherein the paper is charged during xerographic process steps, as at transfer station 13.

Electrically grounded tinsel 35 extends across the 15-inch width of the bin, as does flap 31, and operates to discharge the sheet as the sheet enters the bin. Flap 31, which is electrically nonconductive, operates to deflect the entering sheet downward toward the bin's floor 36. The tinsel is constructed with sharp wire-like points. The electrical field created between the charged sheet and these wire points causes the air between the tinsel and the sheet to ionize, thereby reducing the charge on the sheet's surface. Since the sheet does not physically engage the tinsel, the tinsel wear is minimized. Thus, the tinsel's ability to create an electrical ionizing field, from the sharp points thereof, does not degrade with time.

In order to produce proper stacking, a further feature of the present invention is to construct the collator bin of electrically insulating material. Thus, referring to FIG. 2, the floor of the collator bin 36 and the upper wall 37, which is in fact the floor of the next uppermost bin, is formed of a nonconducting material such as nonconducting plastic.

An essential feature of the present invention is the nonhorizontal, quasi-curved cylindrical bottom floor of the collator bin. In FIG. 2, an exemplary arrangement is shown wherein this floor is formed with a 7.5-inch radius about point 38. Preferably, the bin is tilted down to the rear. Thus, line 60, drawn from one corner to the other of the bin's bottom floor, makes an angle of approximately 15° to horizontal line 61. Dimension 62 is approximately 9.00 inches.

Figure 3:
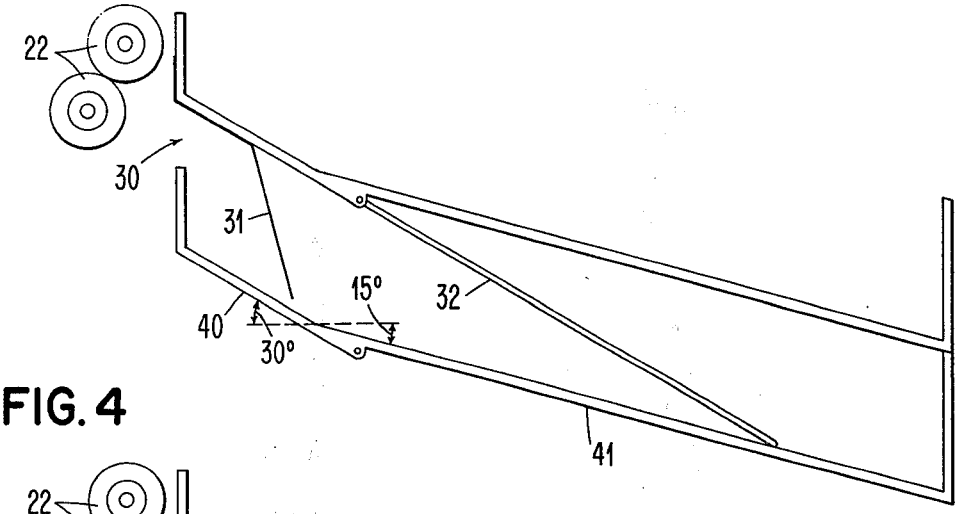
FIG. 3 is a showing of another structure embodying the present invention.

A further embodiment of the present invention is shown in FIG. 3 wherein the bottom floor of the collator is again generally curved, in this case the quasi-curve being provided by two planar sections 40 and 41. The portion 40 is about 2 inches long and extends at an angle of 30° to the horizontal, whereas the portion 41 is about 8.75 inches long and extends at an angle of 15° to the horizontal. Again, the arrangement of FIG. 3 provides flaps 31 and 32.

Figure 4:
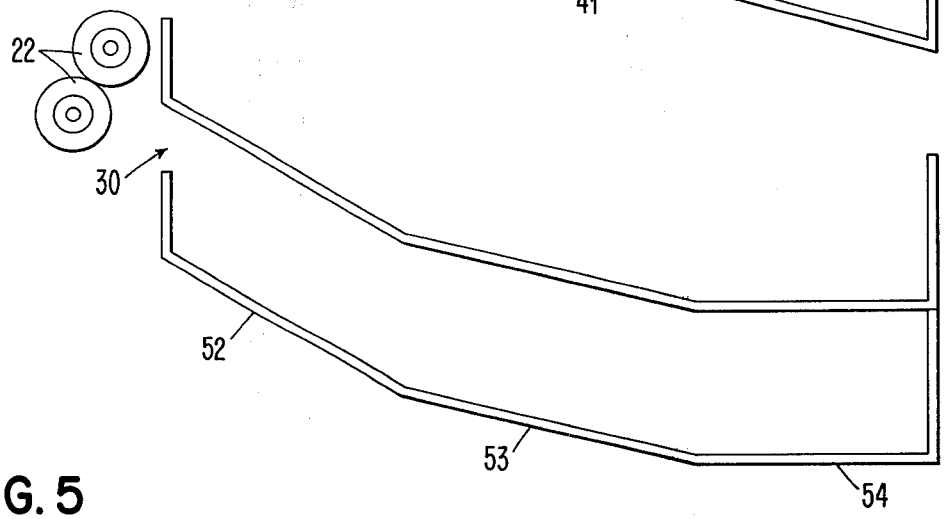
FIG. 4 is a showing of another structure embodying the present invention.

In the embodiment of the present invention shown in FIG. 4, the quasi-curved bottom of the collator bin is formed of three planar sections 52, 53 and 54, the leading section of which is inclined generally at an angle of 15° to the horizontal, and the end sections 52 and 54 of which are oppositely inclined.

FIGS. 2, 3 and 4 show generically what is meant by the term concave planar surface which faces upward and is curved about an axis generally normal to the direction of sheet movement. In each case, the construction embodies the critical feature of this invention, namely, that the curve in the collator bin is greater than the tendency of the sheets to curl.

Figure 5:
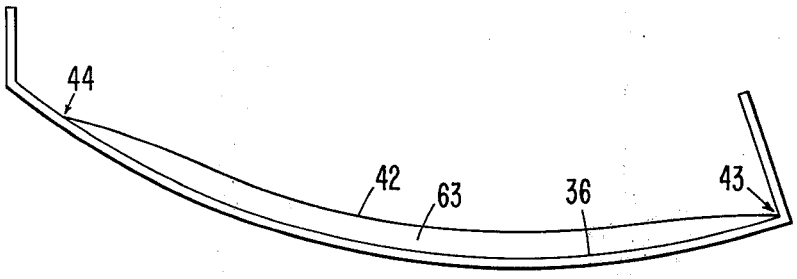
FIG. 5 shows the bottom surface of the bin of FIG. 2 with a sheet of opposite-facing curvature placed therein.

FIG. 5 discloses a typically curled sheet 42 resident within the tray of FIG. 2. In this case, the sheet is curled downward and, as a result, its leading edge 43 and its trailing edge 44 engage the bottom of the collator bin in line contact, thereby causing the center of the sheet to bow downward, this comprising the above-mentioned condition wherein the back of the sheet is broken. A single sheet tends to leave a gap 63. Thus, it can be appreciated that the next sheet to be inserted in the tray can be inserted with no jam-causing engagement with the trailing edge 44 of the sheet or sheets already stacked in the tray. As the sheets stack, gap 63 is reduced to zero.

Figure 6:
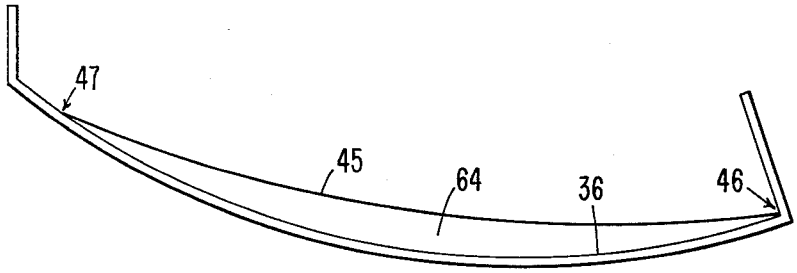
FIG. 6 shows the bottom surface of the bin of FIG. 2 with a sheet of the same facing curvature placed therein.

In FIG. 6, a sheet 45 resides in the tray. In this case, the sheet is normally curved upward. However, in this case, the sheet's leading edge 46 and its trailing edge 47 again engage the floor of the collator bin in line contact since the collator bin is curved more than the sheet is curved. Thus, again, the sheet's back is broken and the sheet maintains contact with the bottom of the collator bin at the sheet's leading and trailing edges so as to avoid a jam-engaging conflict with the leading edge of the sheet next to be placed in the bin. Again, a smaller gap 64 is left for a single sheet, and tends to reduce to zero as more sheets stack in the bin.

The above description of operation likewise applies to the embodiments of the invention shown in FIGS. 3 and 4.

While the invention has been particularly shown and described with reference to three embodiments thereof, it will be understood by those skilled in the art that various changes in form and details may be made therein without departing from the spirit and scope of the invention.

What is claimed is:

1. In a collator adapted to receive curled paper sheets from a printer or copier, and operable to collate the sheets to a plurality of bins, comprising:

means serially feeding said sheets to said bins as the sheets travel in a direction generally normal to the direction of curl;

a plurality of vertically spaced and generally horizontally extending, electrically nonconductive surface members, adjacent ones of which define a bin;

each of said surface members having an upward-facing generally concave planar surface upon which the copy sheets rest in a vertical stack, said concave surface having a greater curvature than the curl of the copy sheets, the axis of said concave surface being generally normal to the direction of sheet travel;

whereby the copy sheets rest in a stack with the leading and trailing edges thereof in packed registry against said planar surface.

2. In the collator defined in claim 1, each of the bins including two gravity-biased hold-down flaps, one cooperating with the leading portion of the sheet stack and the other cooperating with the trailing portion of the sheet stack.

3. In the collator defined in claim 2 wherein said hold-down flap cooperating with the leading portion of the sheet stack is formed to provide a small two-point surface area contact to the stack, and the hold-down flap cooperating with the trailing portion of the sheet stack is an electrical nonconductor.

4. In the collator defined in claim 3 wherein each said bins includes a mouth portion to receive said sheets, said bins being generally downwardly inclined from said mouth portion.

5. A plurality of collator bins for vertically stacking paper sheets which have a tendency to curl, into collated sets, each bin comprising;

a paper tray having an open-end, a closed-end, and parallel but non-planar top and bottom generally horizontal walls, each of said walls including an open-end portion inclined upward to the horizontal; and a closed-end portion inclined at an opposite angle to the horizontal;

the incline of said portions defining an upwardly directed shallow channel whose axis is generally normal to the direction of sheet travel as a sheet enters the tray;

a gravity-biased sheet hold-down means pivoted to the top wall and cooperating to hold sheets against said closed-end portion; and a sheet deflecting means fixed to the top wall and cooperating to hold sheets against said open-end portion.

6. The collator bins defined in claim 5 wherein said shallow channel defines a quasi-curved surface of greater curvature than sheet curl.

7. The collator bins defined in claim 6 wherein the walls of said collator bin are electrically nonconductive.

8. The collator bins defined in claim 7 wherein said hold-down means is a two-piece wire form, and wherein said deflecting means is a flexible plastic-like flap.

9. The collator bins defined in claim 8 wherein said bins are tilted downward such that the stack tends to gravity-rest against said closed end.

* * * * *